US006487755B1

(12) United States Patent
Caldari

(10) Patent No.: US 6,487,755 B1
(45) Date of Patent: Dec. 3, 2002

(54) HIDDEN HINGE

(75) Inventor: Gianfranco Caldari, Riccione (IT)

(73) Assignee: Koblenz S.p.A. (IT)

( * ) Notice: Subject to any disclaimer, the term of this patent is extended or adjusted under 35 U.S.C. 154(b) by 0 days.

(21) Appl. No.: 09/560,588

(22) Filed: Apr. 28, 2000

(30) Foreign Application Priority Data

Jun. 25, 1999 (IT) ..... RN99U0022

(51) Int. Cl.[7] ..... E05D 15/30
(52) U.S. Cl. ..... 16/370; 16/358; 16/287
(58) Field of Search ..... 16/370, 358, 361, 16/362, 366, 382, 287, 286, 288, 369, 390

(56) References Cited

U.S. PATENT DOCUMENTS

| | | | | | |
|---|---|---|---|---|---|
| 1,688,996 | A | * | 10/1928 | Soss | 16/358 |
| 1,925,209 | A | * | 9/1933 | Schwartz | 16/358 |
| 2,021,702 | A | * | 11/1935 | Soss | 16/369 |
| 2,178,271 | A | * | 10/1939 | Soss | 16/358 |
| 3,209,390 | A | * | 10/1965 | Bassan | 16/358 |
| 3,611,474 | A | * | 10/1971 | Meyer | 16/358 |
| 3,673,635 | A | * | 7/1972 | Cencioni | 16/358 |
| 3,805,323 | A | * | 4/1974 | Fukui | 16/390 |
| 3,881,221 | A | * | 5/1975 | Schmidt | 16/366 |
| 3,978,549 | A | | 9/1976 | Vitt | |
| 4,817,241 | A | * | 4/1989 | Koch et al. | 16/370 |
| 4,827,569 | A | * | 5/1989 | Mertes | 16/358 |
| 4,843,680 | A | | 7/1989 | Cress et al. | |
| 4,875,252 | A | * | 10/1989 | Falconer et al. | 16/358 |
| 1,484,093 | A1 | * | 2/2001 | Soss | 16/358 |

FOREIGN PATENT DOCUMENTS

CH 671 066 A5 7/1989

* cited by examiner

*Primary Examiner*—Chuck Y. Mah
*Assistant Examiner*—Doug Hutton
(74) *Attorney, Agent, or Firm*—Browdy and Neimark, P.L.L.C.

(57) ABSTRACT

A hinge for doors or for wings of furniture items comprises fastening elements provided with fixed pivot pins and with sliding guides, which can be housed respectively in the thickness of the door and in a corresponding fixed door post; arms for connecting the door to the door post connected to the fastening elements with their first extremity, hinged on the fixed pivot pin of one of the fastening elements and with a second extremity engaged in the sliding guide of the other fastening element; and a joint interposed at the extremities of the arms which pivotingly connects the arms to each other allowing their relative angular mobility. The fastening elements comprise connecting bodies movable relative to each other at least along one direction defined by at least one of three cartesian axes, respective adjusting means being provided thereto. The arms have mutually different lengths at least in correspondence with their first portion, positioned between the respective first extremities and the intermediate joint, to allow the opening of the door with the rotation thereof relative to the door post, to a condition of parallelism between door and door post and without substantial interposition of space.

46 Claims, 3 Drawing Sheets

HIDDEN HINGE

BACKGROUND OF THE INVENTION

The present invention relates to the manufacture of wings of furniture items and doors in general and in particular it pertains to hidden hinges to articulate the wings to the fixed part of the furniture item and more in general the doors to the related door post.

These hinges, currently called invisible hinges, are partly contained inside the thickness of the door and partly inside the thickness of the door post and comprise in particular two fastening elements to connect the hinge respectively to the door and to the door post; arms, each of which is connected to the two fastening elements with their first extremity hinged on a fixed pivot pin of one of the fastening elements and with the other extremity engaged in a sliding guide borne by the other fastening element; and lastly a pivot pin, interposed at the extremities of the arms, which connects the arms in mutually pivoting fashion being able to move, remaining parallel to itself, in the opening and closing motion of the door.

In rather complicated and sophisticated hinges of this kind no adjustment in any of three directions in space is permitted to the door with respect to its fixed post. Infact, they are provided with fastening means of the hinge which are articulated exclusively with one another, but fixed in space once applied.

Furthermore, in known hinges of this kind, the arms are equal in shape and dimensions and are generally perfectly reversible relative to each other. Moreover, the fastening elements contained in the thickness of the wing and of the door post are opposite and mutually aligned. This conformation of the hinges generally determines the impossibility of positioning the door, in the open condition, flush with the door post when this post is provided with an outer finishing cornice.

In practice, the distance, measured between the front surface of the post and the plane of the door opened at an angle of 180 degrees, is never sufficient to permit the application of a standard finishing cornice, the thickness of which is always greater than such a distance. Generally, therefore, if, as almost always happens, the cited finishing cornices were to be applied on the exterior of the post, the door would open only partially, at an angle of approximately 90 to 100 degrees, unless hollows are produced in the front part of the post so as to allow the application of the cornice, but thus greatly increasing the number of operations and the time needed for the application itself.

SUMMARY OF THE INVENTION

The aim of the present invention is to eliminate such drawbacks by means of a hinge so shaped as to allow the wing to position itself, in the open condition, rigorously flush with a door post having a finishing cornice, the hinge being adjustable along the three cartesian axes, thus permitting the adjustment of door verticality and squaring and the recovery of any imperfection in the assembly.

In accordance with the invention this aim is reached by a hinge according to claim 1, wherein the arms have mutually different lengths, at least in correspondence with their portion positioned between the respective first extremities and the intermediate articulation pivot pin, to allow the complete rotation of the door relative to the door post up to an angle of 180 degrees, at least until reaching a condition in which the door is positioned parallel to the finishing cornice.

The hinge is also provided with adjustment means which allow in particular to adjust the arms along a vertical direction passing through the intermediate pivot pin.

If the adjustment means are so devised as to allow also the adjustment of the hinge along two additional horizontal directions orthogonal to each other and to the vertical direction, the hinge according to the invention is also adjustable in all directions in space.

BRIEF DESCRIPTION OF THE DRAWINGS

The technical features of the invention, according to the aforesaid aims, can clearly be noted from the content of the claims set out below and its advantages shall become more readily apparent in the detailed description that follows, made with reference to the accompanying drawings, which show an embodiment provided purely by way of non limiting example, in which:

DESCRIPTION OF THE PREFERRED EMBODIMENTS

With reference to the accompanying drawings, the reference number 20 globally indicates a hinge for doors 3, or wings of furniture items, of the type hidden in the thickness of the door 3 and in the thickness of the related fixed door post 4, associated to the frame of the door itself or to the fixed structure of the furniture item.

Figure 6:
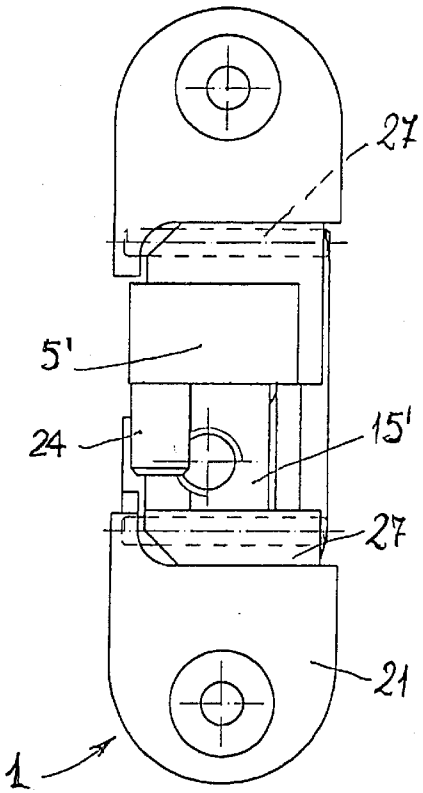
FIGS. 5 and 6 are views of the hinge of FIG. 4 sectioned respectively with the planes V—V and VI—VI and shown with some parts removed the better to highlight others.
Figure 4:
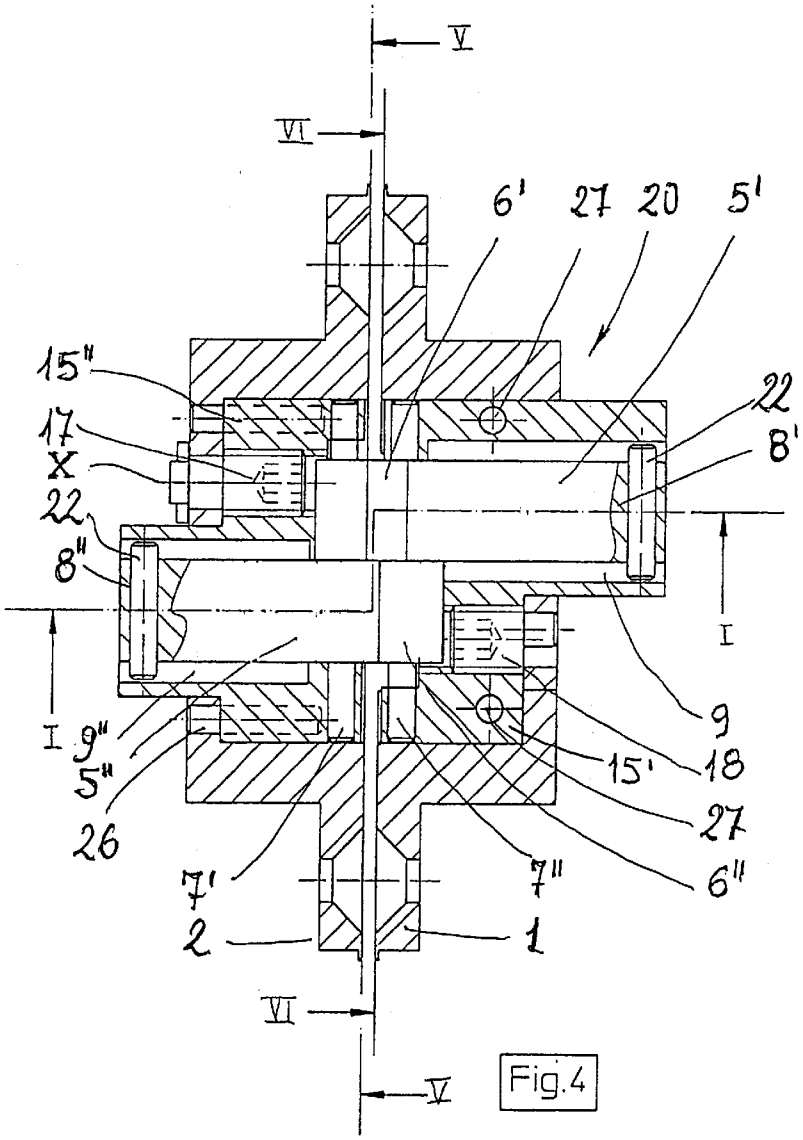
FIG. 4 is an overall view of the hinge sectioned with a vertical plane of trace IV—IV indicated in FIG. 1, showing a view of the arms of the hinges not sectioned.
Figure 5:
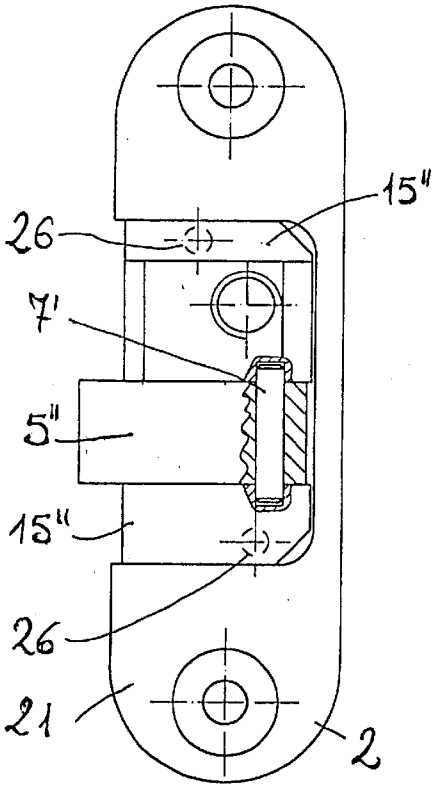

The hinge 20 (FIG. 1) essentially comprises fastening elements 1 and 2, stably secured to the door 3 and to the door post 4, and two arms 5', 5" which, advantageously articulated to each other and to the fastening elements 1, 2, allow to connect the door 3 pivotingly to the door post 4, as is necessary for the related opening and closing. Elastic return means 19 are positioned between the fastening elements 1, 2 and the two arms 5', 5". In particular, the fastening elements are embodied by corresponding internally hollow bodies 1 and 2, preferably made of metallic material and provided with planar flanges 21 (FIGS. 4, 5 and 6). The bodies 1, 2 are housed in the thickness of the door 3 and of the door post 4 (FIGS. 1, 2 and 3) and in the closed condition of the door 3 they are mutually opposite, but not aligned.

Each of the bodies 1 and 2 is internally provided with a fixed pivot pin 7', 7" and with a groove, which embodies a sliding guide 9', 9". The pivot pins 7', 7" are oriented parallel to a vertical direction Z. The sliding guides 9', 9" are instead rectilinear and oriented orthogonal to the pivot pins 7', 7".

Each arm 5', 5" is connected to both fastening elements 2, 1. More in particular, a first extremity 6', 6" of each arm 5', 5" is hinged on the fixed pivot pin 7', 7" of one of the fastening elements 2, 1, whilst the second extremity 8', 8", which is provided with a shoe 22, is engaged in the sliding guide 9", 9' of the other fastening element 2;1.

The two arms 5', 5" are mutually connected in pivoting fashion by a joint 10 situated between the related extremities 6', 8', 6", 8".

Figure 2:
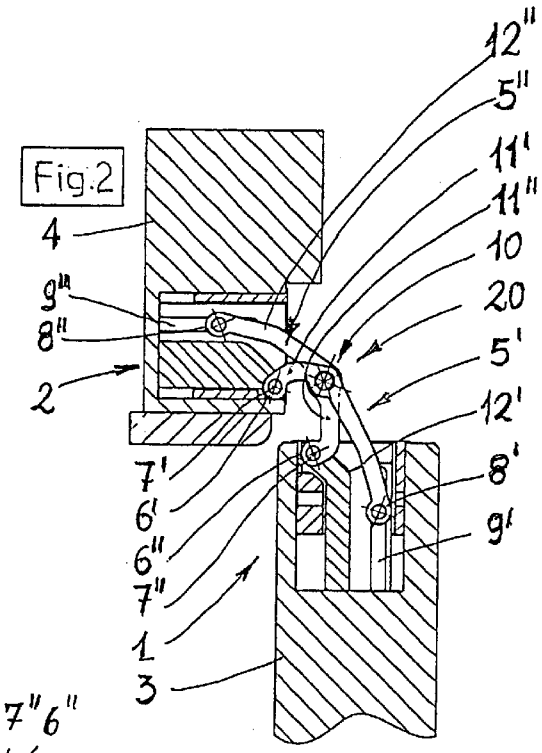
FIGS. 2 and 3 are top plan views of the door and of the door post sectioned as in FIG. 1 and shown respectively in a partially opened and in a fully opened condition of the door.
Figure 3:
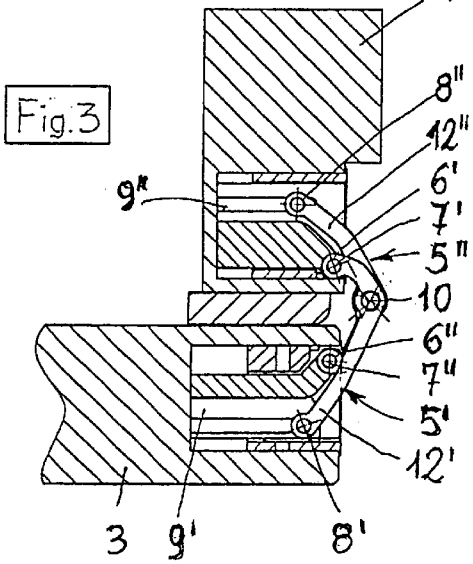

The arms 5', 5" generally have elongated, globally curvilinear shapes, differing in design and dimensions, devised to allow the door 3 to rotate relative to the door post 4 (FIG. 2) between two extreme conditions: in the first whereof, the door 3 is closed and aligned with its own exterior face 13 to the outer finishing cornice 14 applied to the door post 4 (FIG. 1); in the second condition the door 3 being instead open and positioned with its own exterior face 13 in contrast with the outer cornice 14 of the post 4 and without substantial interposition of an intermediate empty space (FIG. 3).

Figure 1:
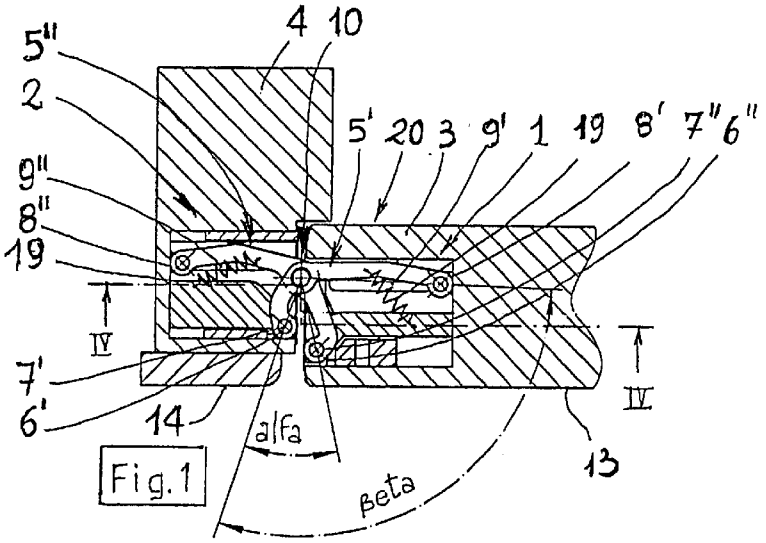
FIG. 1 is a top plan view of a door and of a door post shown in closed condition, provided with hinges according to the invention, and sectioned at the height of one of the hinges with section plane indicated with trace I—I in FIG. 4.

More specifically, defining as first arm portions 11', 11" those parts of the arms 5', 5" that are situated between the first extremities 6', 6" and the intermediate joint 10 and as second arm portions 12', 12" those parts that are instead situated between the intermediate joint 10 and the second extremities 8', 8", one can observe from FIGS. 1, 2 and 3 that the two arms 5', 5" have mutually different lengths, both in correspondence with their first portions 11', 11", and in correspondence with their second portions 12', 12". Moreover, the portions 11', 11", 12', 12" of said arms 5', 5" are embodied by a succession of segments positioned according to an advantageous broken line which, in the closed condition of the door 3, causes the first portions 11', 11" of the arms 5', 5" to be mutually angled according to a suitable angle alpha, whose amplitude is preferably close to 30°; and the second portions 12', 12" to be oriented, relative to the corresponding first portions, according to an angle beta substantially close to 105°.

The hinge 20 is advantageously constructed in such a way as to be also adjustable according to the three spatial directions X, Y, Z and upon the activation of related adjustment means 16, 17, 18.

Figure 7:
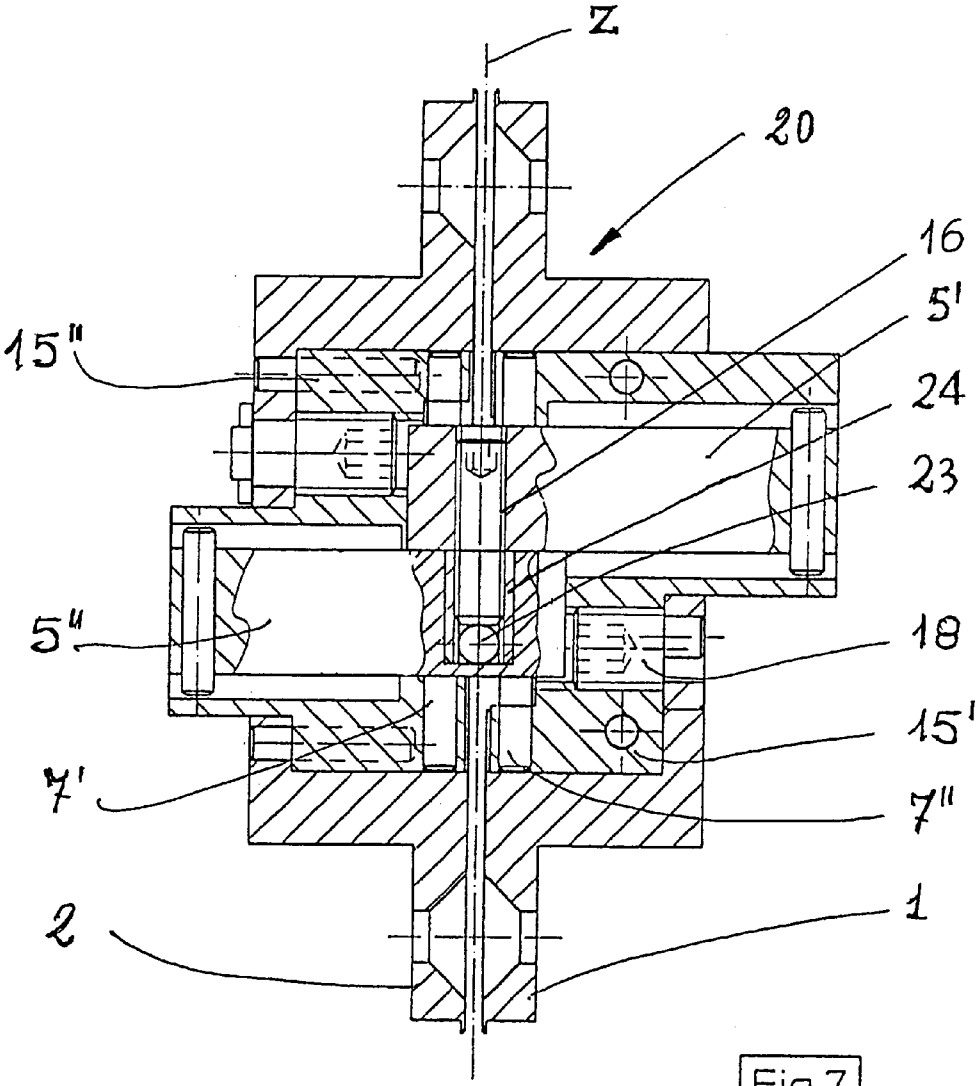
FIG. 7 is a view corresponding to FIG. 4 showing the hinge in a sample adjustment condition.

In particular (FIG. 7), if the intermediate joint 10 of the arms 5', 5" is embodied by a ball 23 which is contained in a seat 24 of the one of the arms 5" and is contrasted by a first rotating dowel 16 borne by the other arm 5' and oriented parallel to the axis of rotation of the joint 10, the rotation of the dowel 16 effected according to one or the other of the possible directions allows to move the arms 5', 5" closer to or farther away from each other and, consequently, allows to adjust the hinge 20 along the vertical direction Z by means of the relative displacement of the fastening elements 1, 2 integral with the two arms 5', 5". In this particular embodiment, the adjustment means acting according to the vertical direction Z thus appear integrated in the same intermediate joint 10 of the arms 5', 5".

In regard to the possibility of adjusting the hinge 20 also along two mutually orthogonal directions, transverse to the vertical direction Z, the embodiment of the invention illustrated in the figures of the accompanying drawings provides in particular for the fastening elements 1, 2 to be constructed in such a way as to comprise: fixed parts embodied by the flanges 21 and movable parts embodied by distinct connecting bodies 15', 15" contained in their inner cavity.

The connecting bodies 15', 15", which bear the pivot pins 7', 7" articulating the arms 5', 5", are able slidingly to translate relative to the fixed parts of the fastening elements 1, 2 along respective pairs of guide rods 26, 27 which are oriented along two mutually orthogonal horizontal directions.

The adjustment means are in this case embodied in such a way as to comprise a second dowel 17 interposed between one of the connecting bodies 15', 15"and the related fastening element 1;2 and acting along a first horizontal direction X and an eccentric 18 positioned between the other connecting body 15", 15' and the related fastening element 1, 2 and acting according to a direction Y orthogonal to the first.

The invention thus conceived can be subject to numerous modifications and variations, without thereby departing from the scope of the inventive concept. Moreover, all components can be replaced by technically equivalent elements.

What is claimed is:

1. A hidden hinge, in particular for doors or for furniture wings, comprising at least two fastening elements, each provided with a fixed pivot pin, a sliding guide and flanges, which can be housed respectively in the thickness of the door and in a corresponding fixed door post;

arms each having a first and second extremity for connecting the door to the door post which are connected to the fastening elements respectively with their first extremity hinged on the fixed pivot pin of one of the fastening elements and with a second extremity engaged in the sliding guide of another fastening element;

a joint interposed between the extremities of the arms which pivotingly connects the arms to each other allowing their relative angular mobility, wherein the fastening elements are movable relative to each other along at least one first direction defined by one of three cartesian axes which is oriented perpendicular to a flange of one of said fastening elements, and wherein said fastening elements have adjustment means to vary the position of the fastening elements along said at least one first direction when the door is in a stationary position relative to the door post and the first and second extremities are exposed.

2. A hinge, as claimed in claim 1, wherein said adjustment means comprises a first dowel which rotates, situated between the arms and oriented parallel to the axis of rotation of the joint, said dowel allowing the arms to move closer or farther away, at least along a vertical direction (Z).

3. A hinge, as claimed in claim 2, wherein the adjustment means are devised to effect the positional adjustment of the fastening elements along two directions transverse to the vertical direction (Z).

4. A hinge, as claimed in claim 3, wherein the fastening elements comprise connecting bodies connected to the arms and able slidingly to translate relative to the fastening elements; the adjustment means comprising at least a second dowel interposed between a connecting body and the related fastening element and acting along a direction (X;Y) transverse to the vertical directions (Z).

5. A hinge, as claimed in claim 4, wherein the adjustment means comprises an eccentric positioned between a connecting body and a related fastening element and acting along a direction (X;Y) transverse to the vertical direction (Z) to adjust the hinge correspondingly along said direction (X;Y).

6. A hinge, as claimed in claim 4, wherein the arms each have a first and a second portion and have mutually different lengths at least in correspondence with the first portion positioned between the respective first extremities and the intermediate joint, to allow the opening of the door with the rotation thereof relative to the door post, to a condition of parallelism between the door and the door post and without substantial interposition of intermediate empty space.

7. A hinge, as claimed in claim 6, wherein said arms have mutually different lengths in correspondence with the second portion position between the second extremities and the joint.

8. A hinge, as claimed in claim 7, wherein each said first and second portion of said arms has an elongated shape and comprise a succession of segments arranged according to a broken line.

9. A hinge, as claimed in claim 8, wherein the first portion of each of the arms is mutually angled according to an appropriate angle alpha.

10. A hinge, as claimed in claim 9, wherein the angle alpha has an amplitude substantially close to 30°.

11. A hinge, as claimed in claim 10, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

12. A hinge, as claimed in claim 11, comprising an elastic return means positioned between the arms and the fastening elements.

13. A hinge, as claimed in claim 11, wherein the arms each have a first and second portion and have mutually different lengths at least in correspondence with the first portion, positioned between the respective first extremities and the intermediate joint, to allow the opening of the door with the rotation thereof relative to the door post, to a condition of parallelism between the door and the door post and without interposition of intermediate empty space.

14. A hinge, as claimed in claim 6, wherein each said first and second portion of said arms has an elongated shape and comprise a succession of segments arranged according to a broken line.

15. A hinge, as claimed in claim 7, wherein the first portion of each of the arms is mutually angled according to an appropriate angle alpha.

16. A hinge, as claimed in claim 6, wherein the first portion of each of the arms is mutually angled according to an appropriate angle alpha.

17. A hinge, as claimed in claim 6, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

18. A hinge, as claimed in claim 1, comprising an elastic return means positioned between the arms and the fastening elements.

19. A hinge, as claimed in claim 2, wherein the arms each have a first and a second portion and have mutually different lengths at least in correspondence with the first portion, positioned between the respective first extremities and the intermediate joint, to allow the opening of the door with the rotation thereof relative to the door post, to a condition of parallelism between the door and the door post and without substantial interposition of intermediate empty space.

20. A hinge, as claimed in claim 3, wherein the arms each have a first and a second portion and have mutually different lengths at least in correspondence with the first portion, positioned between the respective first extremities and the intermediate joint, to allow the opening of the door with the rotation thereof relative to the door post, to a condition of parallelism between the door and the door post and without substantial interposition of intermediate empty space.

21. A hinge, as claimed in claim 5, wherein the arms each have a first and a second portion and have mutually different lengths at least in correspondence with the first portion, positioned between the respective first extremities and the intermediate joint, to allow the opening of the door with the rotation thereof relative to the door post, to a condition of parallelism between the door and the door post and without substantial interposition of intermediate empty space.

22. A hinge, as claimed in claim 13, wherein each said first and second portion of said arms has an elongated shape and comprise a succession of segments arranged according to a broken line.

23. A hinge, as claimed in claim 19, wherein each said first and second portion of said arms has an elongated shape and comprise a succession of segments arranged according to a broken line.

24. A hinge, as claimed in claim 20, wherein each said first and second portion of said arms has an elongated shape and comprise a succession of segments arranged according to a broken line.

25. A hinge, as claimed in claim 13, wherein the first portion of each of the arms is mutually angled according to an appropriate angle alpha.

26. A hinge, as claimed in claims 19, wherein the first portion of each of the arms is mutually angled according to an appropriate angle alpha.

27. A hinge, as claimed in claim 14, wherein the first portion of each of the arms is mutually angled according to an appropriate angle alpha.

28. A hinge, as claimed in claim 22, wherein the first portion of each of the arms is mutually angled according to an appropriate angle alpha.

29. A hinge, as claimed in claim 23, wherein the first portion of each of the arms is mutually angled according to an appropriate angle alpha.

30. A hinge, as claimed in claim 24, wherein the first portion of each of the arms is mutually angled according to an appropriate angle alpha.

31. A hinge, as claimed in claim 8, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

32. A hinge, as claimed in claim 14, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

33. A hinge, as claimed in claim 22, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

34. A hinge, as claimed in claim 23, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

35. A hinge, as claimed in claim 24, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

36. A hinge, as claimed in claim 9, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

37. A hinge, as claimed in claim 25, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

38. A hinge, as claimed in claim 26, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

39. A hinge, as claimed in claim 27, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

40. A hinge, as claimed in claim 28, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

41. A hinge, as claimed in claim 29, wherein the arms are dimensioned and shaped to allow the rotation of the door relative to the door post between two extreme conditions and in one of which the door is closed and aligned with an exterior face thereof to a finishing cornice applied at the door post and in the second condition the door being instead open and positioned with the exterior face in contrast with the cornice of the door post.

42. A hinge, as claimed in claim 30, wherein the arms are dimensioned and shaped to allow the rotation of the door relative to the door post between two extreme conditions, in one of which the door is closed and aligned with an exterior face thereof to a finishing cornice applied at the door post and in the second condition the door being instead open and positioned with the exterior face in contrast with the cornice of the door post.

43. A hidden hinge, as in claim 1, wherein the fastening elements are movable relative to each other along a second direction of three Cartesian axes which is oriented parallel to the flange of one said fastening element and perpendicular to said first direction.

44. A hidden hinge as in claim 43, wherein the fastening elements are movable relative to each pother along a third direction of the cartesian axes perpendicular to said first and second directions.

45. A hidden hinge, as claimed in claim 11, wherein the fastening elements are movable relative to each other along at least one first direction defined by one of three cartesian axes and at least second direction defined by one of the three cartesian axes which is oriented along a vertical direction (Z), and wherein said fastening elements have adjustment means to vary the position of the fastening elements along said at least first and second direction when the door is in a stationary position relative to the door post and the first and second extremities are exposed.

46. A hidden hinge, in particular for doors or for furniture wings, comprising at least two fastening elements, each provided with a fixed pivot pin and with a sliding guide, which can be housed respectively in the thickness of the door and in a corresponding fixed door post; arms each having a first and second extremity for connecting the door to the door post which are connected to the fastening elements respectively with their first extremity hinged on the fixed pivot pin of one of the fastening elements and with a second extremity engaged in the sliding guide of another fastening element; and a joint interposed between the extremities of the arms which pivotingly connects the arms to each other allowing their relative angular mobility, wherein the fastening elements are movable relative to each other along at least one direction of three directions defined by three cartesian axes when the door is in a stationary position relative to the door post and the first and second extremities are exposed, and wherein said fastening elements have adjustment means to vary the position of the fastening elements along each of the three directions.

* * * * *

UNITED STATES PATENT AND TRADEMARK OFFICE

CERTIFICATE OF CORRECTION

PATENT NO. : 6,487,755 B1
DATED : December 3, 2002
INVENTOR(S) : Gianfranco Caldari It is certified that error appears in the above-identified patent and that said Letters Patent is hereby corrected as shown below:

Column 5,
Line 25, delete “11” and insert therefor -- 1 --;

Column 8,
Line 24, delete “11” and insert therefor -- 1 --.

Signed and Sealed this

Twenty-seventh Day of May, 2003

JAMES E. ROGAN
*Director of the United States Patent and Trademark Office*